US009427850B2

(12) United States Patent
Ullrich et al.

(10) Patent No.: US 9,427,850 B2
(45) Date of Patent: Aug. 30, 2016

(54) DRYWALL SCREWDRIVER

(75) Inventors: Andre Ullrich, Leinfelden-Echterdingen (DE); Holger Froehling, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 335 days.

(21) Appl. No.: 14/130,075

(22) PCT Filed: Jun. 1, 2012

(86) PCT No.: PCT/EP2012/060331

§ 371 (c)(1),
(2), (4) Date: Mar. 28, 2014

(87) PCT Pub. No.: WO2013/000658

PCT Pub. Date: Jan. 3, 2013

(65) Prior Publication Data

US 2014/0230609 A1 Aug. 21, 2014

(30) Foreign Application Priority Data

Jun. 30, 2011 (DE) ..... 10 2011 078 385

(51) Int. Cl.
*B25B 21/00* (2006.01)
*B25B 23/00* (2006.01)

(52) U.S. Cl.
CPC ..... *B25B 21/00* (2013.01); *B25B 23/0064* (2013.01)

(58) Field of Classification Search
CPC . B25B 21/00; B25B 21/007; B25B 23/0064; B25B 23/1425; B25B 23/1427; B25B 21/002; B25F 5/001; B25F 5/02
See application file for complete search history.

(56) References Cited

U.S. PATENT DOCUMENTS

| | | | | |
|---|---|---|---|---|
| 5,044,233 | A | 9/1991 | Tatsu et al. | |
| 5,360,073 | A * | 11/1994 | Akazawa | B25B 23/0064 173/15 |
| 6,213,224 | B1 | 4/2001 | Furuta et al. | |
| 6,758,116 | B2 * | 7/2004 | Kriaski | B25B 23/0064 173/13 |
| 8,961,358 | B2 * | 2/2015 | Hirabayashi | B25B 21/008 475/298 |
| 9,016,398 | B2 * | 4/2015 | Steckel | B25B 21/00 173/181 |
| 9,109,670 | B2 * | 8/2015 | Roehm | B25F 5/001 475/293 |
| 9,212,725 | B2 * | 12/2015 | Steckel | B25B 21/00 475/149 |
| 2013/0167691 | A1 * | 7/2013 | Ullrich | B25B 21/00 81/57.11 |

FOREIGN PATENT DOCUMENTS

| | | |
|---|---|---|
| CN | 201744959 U | 2/2011 |
| DE | 199 27 487 A1 | 1/2000 |
| JP | 2004-202614 A | 7/2004 |

OTHER PUBLICATIONS

International Search Report corresponding to PCT Application No. PCT/EP2012/060331, mailed Oct. 1, 2012 (German and English language document) (5 pages).

* cited by examiner

*Primary Examiner* — David B Thomas
(74) *Attorney, Agent, or Firm* — Maginot, Moore & Beck LLP

(57) ABSTRACT

A drywall screwdriver includes a housing, an element delimiting the depth of engagement, a drive unit, an outlet spindle, and a planetary gear that comprises at least one hollow wheel. The drywall screwdriver further comprises at least one support element that is different from a housing element and that at least partially surrounds the ring gear of the planetary gear.

17 Claims, 3 Drawing Sheets

DRYWALL SCREWDRIVER

This application is a 35 U.S.C. §371 National Stage Application of PCT/EP2012/060331, filed on Jun. 1, 2012, which claims the benefit of priority to Serial No. DE 10 2011 078 385.7, filed on Jun. 30, 2011 in Germany, the disclosures of which are incorporated herein by reference in their entirety.

BACKGROUND

Drywall screwdrivers comprising a housing, comprising a screw-in depth limiting element, comprising a drive unit, comprising an output spindle and comprising a planetary gear unit, which latter has at least one ring gear, are already known.

SUMMARY

The disclosure is based on a drywall screwdriver comprising a housing, comprising a screw-in depth limiting element, comprising a drive unit, comprising an output spindle and comprising a planetary gearing, which latter has at least one ring gear.

It is proposed that the drywall screwdriver has at least one support element, which differs from a housing element and which at least partially embraces the ring gear of the planetary gearing. By a "drywall screwdriver" should in this context be understood, in particular, a portable machine tool which is designed to machine materials, such as, for example, plasterboard, and preferably to screw screws into materials such as, for example, plasterboard. By "designed" should be understood, in particular, specially configured, arranged and/or equipped. By a "screw-in depth limiting element" should in this context be understood, in particular, an element which is at least substantially designed to limit a screw-in depth of the drywall screwdriver. In a particularly preferred embodiment, the screw-in depth limiting element has a depth stop. Preferably, a screw-in depth of the screw-in depth limiting element can be made adjustable. Other limit parameters which appear sensible to a person skilled in the art, such as, for example, a rotation speed or a torque, are also, however, conceivable. The screw-in depth limiting element can be of electronic, magnetic, optical or other configuration which appears sensible to a person skilled in the art. In a particularly preferred illustrative embodiment, the screw-in depth limiting element is of mechanical configuration. Furthermore, by a "drive unit" should be understood, in particular, an electrical and/or mechanical motor unit, which is designed, during operation, advantageously to generate a rotary motion. By this should advantageously be understood, in particular, an electric motor. By a "planetary gearing" should be understood, in particular, a unit which is designed to transform an incoming torque into an outgoing differing torque and/or an input rotation speed into a differing output rotation speed. The planetary gearing preferably comprises at least two, preferably three planet gears, as well as at least one sun gear or pinion. Moreover, the planetary gearing preferably comprises a planet carrier element on which at least two, preferably three planet gears are rotatably arranged. Preferably, the planet gears are arranged by means of bolts on the planet carrier element. Furthermore, the planetary gearing preferably has at least one ring gear. By a "support element" should be understood, in particular, an element constructed separate from the housing, which element is designed to absorb and/or divert forces from at least one direction. Preferably, the support element is designed to support axial forces.

As a result of the disclosed configuration, forces can advantageously be transmitted and/or diverted without, by additional support forces, restricting the ring gear in its motional play. In addition, a small loading and long working life of the planetary gearing can thereby be achieved.

It is further proposed that the support element accommodates the ring gear of the planetary gearing with a radial and/or axial play. Hence an automatic centering of the planetary gearing can advantageously be achieved. Furthermore, a simple assembly can be realized.

In addition, it is proposed that the ring gear of the planetary gearing has in an axial direction at least one projection. The projection can have various cross sections which appear sensible to the person skilled in the art, though, particularly advantageously, the projection has at least one rectangular cross-sectional area. In addition, it would also be conceivable for the ring gear of the planetary gearing to have in a radial direction at least one projection. A shape of the ring gear which forms at least one reference element to enable simple assembly can hence be configured in a constructively simple manner. In addition, a form closure, at least in the radial and in the peripheral direction, can advantageously be realized with another element.

It is further proposed that the support element has a collar extending at least partially radially inward and having at least one recess. Hence an axially large surface area of the support element can particularly advantageously be provided, whereby an advantageous supporting of a component against the support element is enabled.

It is further proposed that the at least one projection of the ring gear reaches through the at least one recess of the collar of the support element, into a recess of the housing. Hence a skewing of the ring gear and a skewing of the support element relative to the housing can reliably be prevented. Furthermore, a simple assembly of the components can be realized.

In addition, it is proposed that the planetary gearing has at least one bearing unit, which is at least partially axially supported against the collar of the support element. By a "bearing unit" should be understood, in particular, a unit which at least in one direction can absorb supporting forces and, moreover, enables a relative motion between two components with low friction losses. By this should advantageously be understood, in particular, a slide bearing and/or, particularly advantageously, a roller bearing. Other bearing units which appear sensible to the person skilled in the art are also, however, conceivable. The slide bearing here advantageously has a material pairing on a sliding surface, which material pairing, at least on the sliding surface, has a friction coefficient which is less than a friction coefficient obtained with a material pairing between a material of the planet carrier element and a material of the housing. Hence axial forces of the output spindle and of the planetary gearing can advantageously be transmitted to the support element.

It is further proposed that the housing comprises at least one gear casing and at least one motor casing. A simple two-part assembly can thereby be realized particularly advantageously. Moreover, the individual housing parts can be tailored to their particular requirements.

In addition, it is proposed that the support element is accommodated at its outer diameter in a play-free manner in the at least one gear casing and the at least one motor casing. A simple installation of the support element can hence advantageously be realized. In addition, a connection between the gearing and the motor casing can advantageously be realized, whereby forces can be conducted to the motor casing.

It is further proposed that the drywall screwdriver has at least one cover plate, which is disposed in the motor casing and against which the ring gear and the support element are at least partially axially supported. An axial force transmission from the ring gear and the support element to the motor casing can hence be realized particularly advantageously. In addition, an end closure for the gearing can be formed in a constructively simple manner by the cover plate.

It is further proposed that the support element connects the gear casing and the motor casing in the manner of a socket. By "connects in the manner of a socket" should in this context be understood, in particular, a connection between two preferably tube-like components by means of an element that bears against at least one outer and/or inner face of both components. Preferably the element has an outer and/or inner diameter corresponding to the inner and/or outer diameters of the components. Particularly preferably, the element is disposed in a connecting region of the components and is designed to align the axes of the components with respect to each other. Hence an accurate and reliable mutual alignment of the gear casing and motor casing can advantageously be achieved.

BRIEF DESCRIPTION OF THE DRAWINGS

Further advantages derive from the following drawing description. In the drawings, illustrative embodiments of the disclosure are represented. The drawings, the description and the claims contain numerous features in combination. The person skilled in the art will expediently also view the features individually and combine them into sensible further combinations.

DETAILED DESCRIPTION

Figure 1:
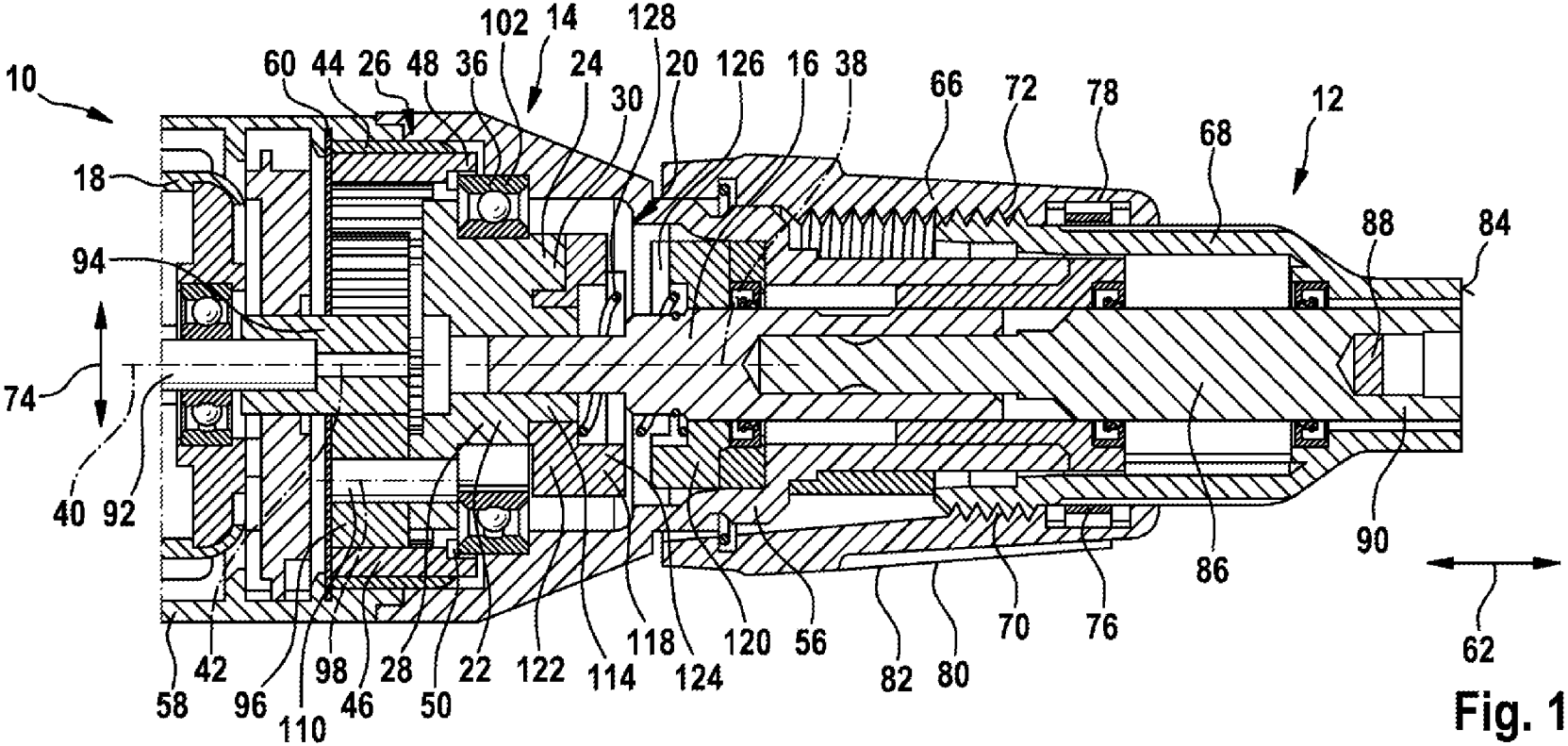
FIG. 1 shows a partial detail of a drywall screwdriver according to the disclosure in a side view.

In FIG. 1, a partial detail of a drywall screwdriver according to the disclosure is represented in a side view. The drywall screwdriver has a housing 10. The housing 10 comprises a gear casing 56 and a motor casing 58. The gear casing 56 is produced in pot construction. The motor casing 58 is produced in shell construction. The drywall screwdriver additionally has a screw-in depth limiting element 12, a gear unit 14, an output spindle 16, a drive unit 18 and a clutch unit 20. The drive unit 18 is configured as a direct-current motor.

At one end of the gear casing 56, which end, viewed in an axial direction 62 of the gear casing 56, is facing away from the motor casing 58, is disposed the screw-in depth limiting element 12. The screw-in depth limiting element 12 is connected by means of a plug connection detachably to the housing 10 of the drywall screwdriver. The screw-in depth limiting element 12 comprises an adjusting sleeve 66. The screw-in depth limiting element 12 also comprises a depth stop 68. The depth stop 68 is designed to limit a screw-in depth of a screw in a screw-in operation. The adjusting sleeve 66 is designed to adjust the screw-in depth. The screw-in depth is here adjusted manually by means of the adjusting sleeve 66. To this end, an operator turns the adjusting sleeve 66 about an axis corresponding to an axis 38 of the output spindle 16. When the adjusting sleeve 66 is turned by the operator, the depth stop 68 is moved along the axial direction 62.

The adjusting sleeve 66 has an internal thread 70. The internal thread 70 extends over a section of an inner face of the adjusting sleeve 66. The depth stop 68 has an external thread 72. The external thread 72 extends over a section of an outer face of the depth stop 68. In an assembled state of the screw-in depth limiting element 12, the external thread 72 of the depth stop 68 and the internal thread 70 of the adjusting sleeve 66 engage in each other. In the radial direction 74, viewed from outside to inside, a spring element 76 is disposed in front of the depth stop 68. The spring element 76 presses the depth stop 68 inward in the radial direction 74. The spring element 76 is disposed in a radially inner depression 78 of the adjusting sleeve 66. The radially inner depression 78 is disposed at one end of the adjusting sleeve 66, which end, in the axial direction 62, is facing toward the depth stop 68. The radially inner depression 78 secures the spring element 76 in the axial direction 62. The spring element 76 presses flanks of the external thread 72 of the depth stop 68 in the radial direction 74 against flanks of the internal thread 70 of the adjusting sleeve 66 in a region which lies opposite the spring element 76 in the radial direction 74. A friction is thereby generated between the flanks of the internal thread 70 and of the external thread 72. As a result of this friction, an automatic adjustment of the depth stop 68 can be reliably prevented. Moreover, the screw-in depth limiting element 12 has latching elements (not represented), which are designed to divide the rotation of the adjusting sleeve 66 into individual latching steps. As a result of the latching elements, an automatic adjustment of the depth stop 68 can further be reliably prevented.

The adjusting sleeve 66 has a grip region 80, which is disposed on an outer side of the adjusting sleeve 66. The grip region 80 has lamellar elevations 82. The grip region 80 is designed to increase the grip of the outer side of the adjusting sleeve 66 and thereby make it easier for the operator to turn the adjusting sleeve 66.

The depth stop 68 has a stop face 84, which, once that screw-in depth of the screw which has been set by the operator is reached, bears upon a surface of a machined workpiece. The stop face 84 has an annular cross section.

The drywall screwdriver has to a tool receiving fixture 86. The tool receiving fixture 86 is formed by a bit holder. The tool receiving fixture 86 has a magnetic element 88 for holding an insert tool (not represented) captively in the tool receiving fixture.

The tool receiving fixture 86 has a receiving region 90. The receiving region 90 is designed to receive the insert tool. The receiving region 90 has a hexagon socket contour (not represented in detail). In an inserted state, the insert tool is held in a rotationally secure manner in the receiving region 90 of the tool receiving fixture 86.

The output spindle 16 is connected in a rotationally secure manner to the tool receiving fixture 86. The tool receiving fixture 86 is connected in a rotationally secure manner to the insert tool inserted therein and transmits the kinetic energy to the insert tool.

Via the gear unit 14 and the clutch unit 20, a kinetic energy of the drive unit 18 is transmitted in a screw-in operation to the output spindle 16 and thus to the tool receiving fixture 86. The clutch unit 20 is designed to couple and/or decouple a torque transmission of the gear unit 14 to the output spindle 16. A gear element 22 of the gear unit 14 is fixedly connected to a coupling element 24 of the clutch unit 20. The gear element 22 of the gear unit 14 is configured in one piece with the coupling element 24 of the clutch unit 20. The gear unit 14 comprises a planetary gearing 26. The planetary gearing 26 of the gear unit 14 is of single-step configuration. The gear unit 14 has a transmission ratio between 3 and 10.

The coupling element 24 comprises three driving elements 30, 32, 34. The driving elements 30, 32, 34 are configured in one piece with the planet carrier element 28 of the planetary gearing 26.

The drive unit 18 comprises a motor spindle 92. In an operating state, the drive unit 18 generates a rotary motion of the motor spindle 92. On the motor spindle 92 is disposed a gearwheel. The gearwheel forms a sun gear 94 of the planetary gearing 26 of the gear unit 14. In an operating state, the sun gear 94 of the planetary gearing 26 meshes with planet gears 96 of the planetary gearing 26. In an operating state, the planet gears 96 rotate respectively about a rotational axis 98 of the planet gears 96. Moreover, the planet gears 96 rotate about a rotational axis of the sun gear 94, which rotational axis corresponds to an axis 42 of the gear unit 14. The axis 42 of the gear unit 14 corresponds to an axis 40 of the drive unit 18. The axis 38 of the output spindle 16 corresponds to the axis 40 of the drive unit 18. The rotational axis of the motor spindle 92 corresponds to the axis 40 of the drive unit 18.

Figure 3:
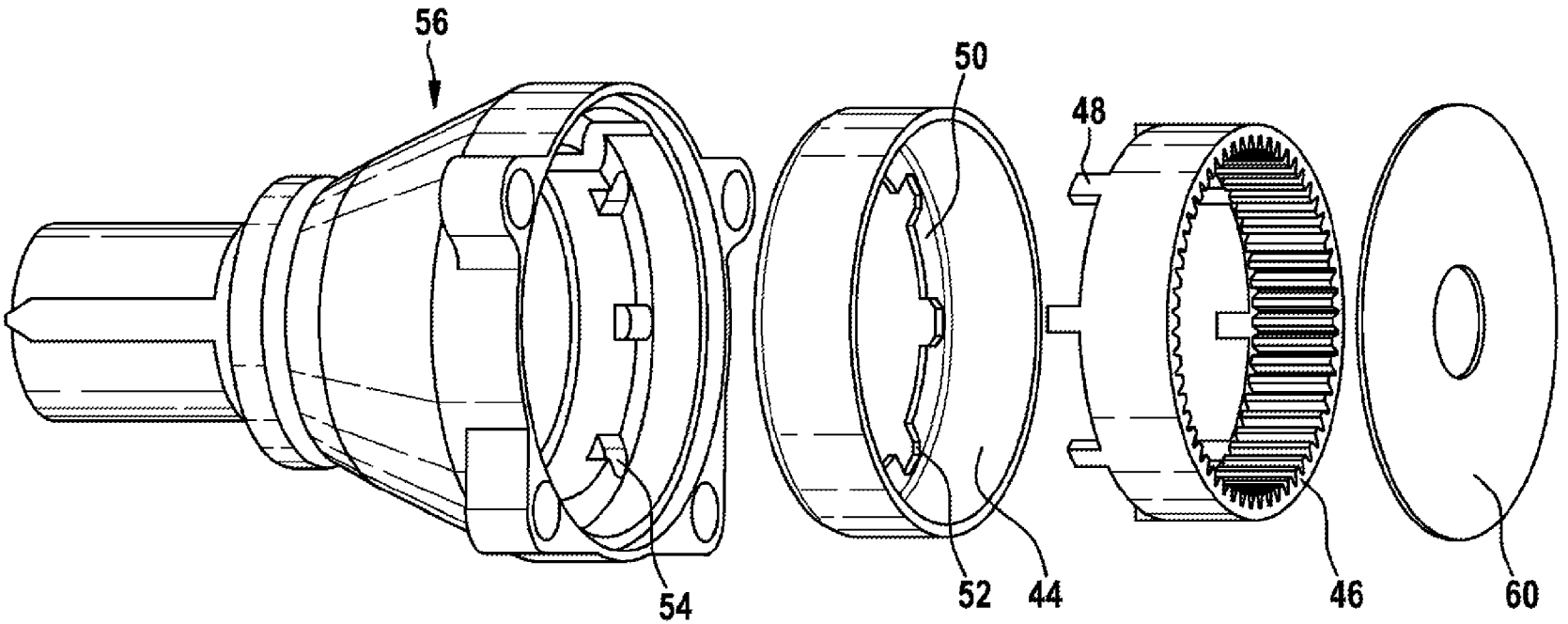
FIG. 3 shows a gear casing, a support element, a ring gear and a cover plate of the drywall screwdriver according to the disclosure in a schematic exploded representation.

The planetary gearing 26 has a ring gear 46. In an operating state, the planet gears 96 mesh with the ring gear 46 of the planetary gearing 26. The ring gear 46 of the planetary gearing 26 is disposed, in a rotationally secure manner relative to the housing 10 of the drywall screwdriver, in the gear casing 56 of the drywall screwdriver. The drywall screwdriver has a support element 44 which differs from a housing element and which embraces the ring gear 46 of the planetary gearing 26. The support element 44 is disposed between the ring gear 46 and the housing 10. The support element 44 is accommodated at its outer diameter in a play-free manner in the gear casing 56 and the motor casing 58. The support element 44 connects the gear casing 56 and the motor casing 58 in the manner of a socket. The support element 44 is formed by a connecting sleeve. The connecting sleeve is formed by a sheet metal bush. The support element 44 embraces the ring gear 46 of the planetary gearing 26 with a radial and axial play. The ring gear 46 of the planetary gearing 26 has in the axial direction 62 at least one projection 48. The projections 48 are formed-on on a side of the ring gear 46 that is facing toward the screw-in depth limiting element 12. The support element has a collar 50 extending at least partially radially inward and having at least one recess 52. The collar 50 extends inward on a plane running orthogonally to the axial direction. In addition, the collar 50 has eight recesses 52. The projections 48 of the ring gear 46 reach through the recesses 52 of the collar 50 of the support element 44 into eight recesses 54 of the gear casing 56, whereby the ring gear 46 is fixed in the peripheral direction (see FIG. 3).

The planet carrier element 28 is supported directly in the housing by means of a bearing unit 36. The bearing unit 36 is press-fitted on a radial outer face of the planet carrier element 28. The bearing unit 36 is formed by a roller bearing 102. The bearing unit 36 is supported with its outer periphery directly against an inner face of the gear casing 56. The bearing unit 36 has an axial motional play in relation to the inner face of the gear casing 56. The bearing unit 36 is partially axially supported against the collar 50 of the support element 44. In the axial direction 62, the bearing unit 36, on a side facing toward the screw-in depth limiting element 12, is supported against the gear casing 56. On a side which, viewed in the axial direction 62, is facing away from the screw-in depth limiting element, the bearing unit 36 is supported against the collar 50 of the support element 44. In the case of a force acting axially on the output spindle 16, the force can be relayed via the clutch unit 20 to the planet carrier element 28. From the planet carrier element 28, the axial force can be relayed by means of an active pressing to the bearing unit 36. The bearing unit 36 is supported in the axial direction 62 against the collar 50 of the support element 44, whereby an axial force is relayed to the support element 44. The support element 44 is axially supported against a cover plate 60. The cover plate 60 is disposed in the motor casing 58. The cover plate 60 is held radially and axially in the motor casing 58 via a circumferential groove encircling the motor casing 58. An axial force can hence be diverted from the support element 44, via the cover plate 60, to the motor casing 58. Accordingly, a force acting axially on the output spindle 16 can be diverted to the motor casing 58. At least partially axially supported against the cover plate 60 are the ring gear 46 and the support element 44. The ring gear 46 and the support element 44 are axially supported against the cover plate 60 on a side which, viewed in the axial direction 62, is facing away from the screw-in depth limiting element.

On a side facing toward the drive unit 18, the planet carrier element 28 has three recesses 104, 106, 108. Through the three recesses 104, 106, 108, three bolts 110 are guided. In turn, the three planet gears 96 are mounted on the three bolts 110. In addition, the planet carrier element 28 has a recess 112, which runs axially to the axis 38 of the output spindle 16. The output spindle 16 is mounted and/or guided partially in the gear element 22 of the gear unit 14. The output spindle 16 is partially mounted and guided in the planet carrier element 28 of the planetary gearing 26. In the recess 112, the output spindle 16 is guided in an axially movable manner. The planet carrier element 28 is designed to transmit the rotary motion of the planet gears 96 about the rotational axis of the sun gear 94 to the clutch unit 20.

Figure 2:
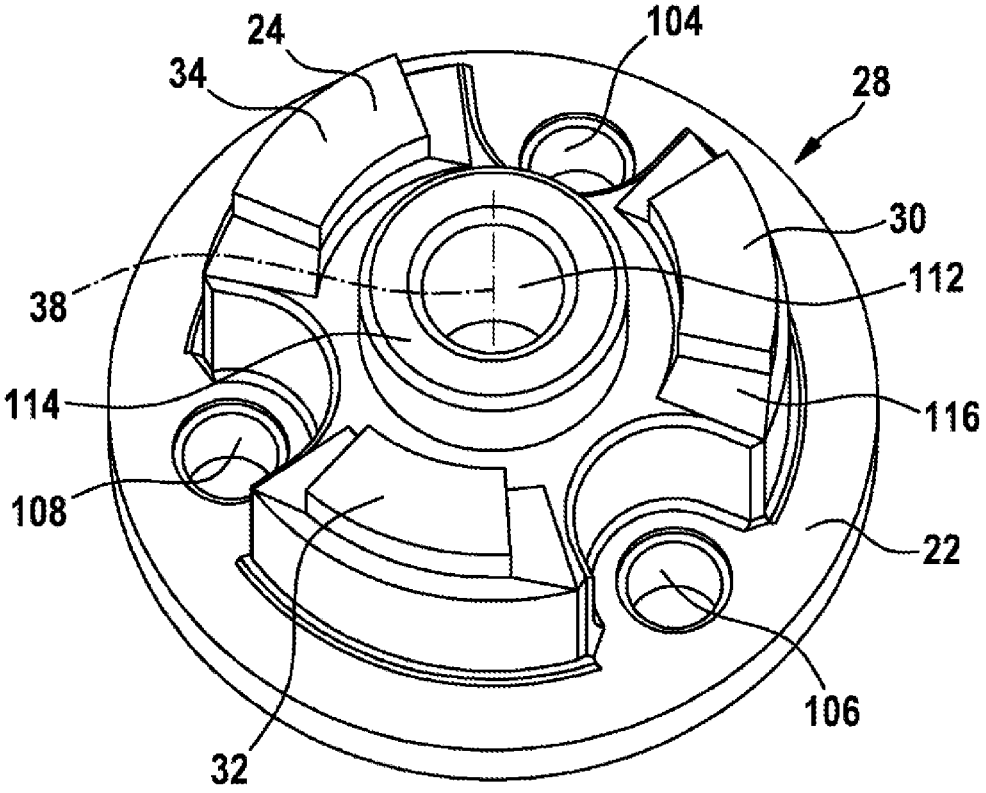
FIG. 2 shows a planet carrier element of the drywall screwdriver according to the disclosure in a schematic representation.

On a side of the planet carrier element 28 that is facing toward the screw-in depth limiting element 12, a collar 114 is arranged around the recess 112. Radially spaced around the collar 114, the three driving elements 30, 32, 34 of the first coupling element 24 are formed onto the planet carrier element 28. The driving elements 30, 32, 34 have on their faces facing in the peripheral direction end ramps 116 (see FIG. 2). The clutch unit 20 has, in addition to the first coupling element 24, a second coupling element 118 and a third coupling element 120. The second coupling element 118 has both on a side facing toward the first coupling element 24 driving elements 122, and on a side facing away from the first coupling element 24 driving elements 124. On a side facing toward the second coupling element 118, the third coupling element 120 has driving elements 126. The driving elements 30, 32, 34, 122, 124, 126 project respectively in the axial direction. In an operating state, the first coupling element 24 is rotationally driven by the planet carrier element 28 directly from the gear unit 14. The second coupling element 118 is seated on the collar 114 of the planet carrier element 28 such that it is movable axially and in the peripheral direction, and is engaged with the first coupling element 24. The third coupling element 120 is fixedly connected to the output spindle 16.

Between the second coupling element 118 and the third coupling element 120 is disposed, in the axial direction 62, a spring element 128. The spring element 128 is configured as a helical spring. The spring element 128 is designed to keep the second coupling element 118 and the third coupling element 120, in a non-actuated state (as represented in FIG. 1), disengaged. To this end, the spring element 128 forces the second coupling element 118 and the third coupling element 120 apart in the axial direction 62.

In an actuated state, the operator presses the drywall screwdriver in the axial direction 62 against a workpiece. As a result of the force which an operator applies to the drywall screwdriver in a screw-in operation, the third coupling element 120 moves toward the second coupling element 118 counter to a spring force of the spring element 128. If a contact arises between the second coupling element 118 and the third coupling element 120, the second coupling element 118 is braked in relation to the first coupling element 24. The second coupling element 118 is thereby pushed onto the end ramps 116 of the first coupling element 24 and moved against the third coupling element 120, whereby coupling is aided.

The driving elements 30, 32, 34, 122, 124, 126 of the first coupling element 24, of the second coupling element 118 and of the third coupling element 120 are designed to, in an actuated state, bear one against another in a peripheral direction of the rotary motion of the gear unit 14. The driving elements 30, 32, 34 of the first coupling element 24 here transmit the rotary motion of the gear unit 14 to the driving elements 122 of the second coupling element 118 and thus to the second coupling element 118. The driving elements 124 of the second coupling element 118 transmit the rotary motion of the gear unit 14 to the driving elements 126 of the third coupling element 120 and thus to the third coupling element 120.

Once the operator-set screw-in depth of a screw is reached, the stop face 84 of the depth stop 68 bears upon a surface of the workpiece. In this state, the force in the axial direction 62 which the operator applies to the drywall screwdriver is transmitted via the depth stop 68 to the workpiece, instead of to an insert tool. This causes the third coupling element 120, which is subjected to load by the spring element 128, to disengage from the second coupling element 118, so that the rotary motion of the gear unit 14 is no longer transmitted to the third coupling element 120, or to an insert tool.

The invention claimed is:

1. A drywall screwdriver comprising:
a housing;
a screw-in depth limiting element;
a drive unit;
an output spindle;
a planetary gearing including at least one ring gear; and
at least one support element, which differs from a housing element and which at least partially embraces the at least one ring gear of the planetary gearing,
wherein the support element includes a collar extending at least partially radially inwardly, the collar having at least one recess.

2. The drywall screwdriver as claimed in claim 1, wherein the support element accommodates the ring gear of the planetary gearing with at least one of a radial play and an axial play.

3. The drywall screwdriver as claimed in claim 1, wherein the ring gear of the planetary gearing includes at least one projection in an axial direction.

4. The drywall screwdriver as claimed in claim 1, wherein:
the ring gear of the planetary gearing includes at least one projection in an axial direction, and
the at least one projection of the ring gear extends through the at least one recess of the collar of the support element into a housing recess of the housing.

5. The drywall screwdriver as claimed in claim 1, wherein the planetary gearing includes at least one bearing unit, which is at least partially axially supported against the collar of the support element.

6. The drywall screwdriver as claimed in claim 1, wherein the housing includes at least one gear casing and at least one motor casing.

7. The drywall screwdriver as claimed in claim 6, wherein the support element is accommodated at an outer diameter without play in the at least one gear casing and the at least one motor casing.

8. The drywall screwdriver as claimed in claim 6, further comprising:
at least one cover plate disposed in the at least one motor casing and against which the ring gear and the support element are at least partially axially supported.

9. The drywall screwdriver as claimed in claim 6, wherein the support element connects the gear casing and the motor casing in the manner of a socket.

10. A drywall screwdriver comprising:
a housing that includes:
at least one gear casing; and
at least one motor casing;
a screw-in depth limiting element;
a drive unit;
an output spindle;
a planetary gearing including at least one ring gear; and
at least one support element, which differs from a housing element and which at least partially embraces the at least one ring gear of the planetary gearing,
wherein the support element is accommodated at an outer diameter without play in the at least one gear casing and the at least one motor casing.

11. The drywall screwdriver as claimed in claim 10, wherein the support element accommodates the ring gear of the planetary gearing with at least one of a radial play and an axial play.

12. The drywall screwdriver as claimed in claim 10, wherein the ring gear of the planetary gearing includes at least one projection in an axial direction.

13. The drywall screwdriver as claimed in claim 10, wherein the support element includes a collar extending at least partially radially inwardly, the collar having at least one recess.

14. The drywall screwdriver as claimed in claim 13, wherein:
the ring gear of the planetary gearing includes at least one projection in an axial direction, and
the at least one projection of the ring gear extends through the at least one recess of the collar of the support element into a housing recess of the housing.

15. The drywall screwdriver as claimed in claim 13, wherein the planetary gearing includes at least one bearing unit, which is at least partially axially supported against the collar of the support element.

16. The drywall screwdriver as claimed in claim 10, further comprising:
at least one cover plate disposed in the at least one motor casing and against which the ring gear and the support element are at least partially axially supported.

17. The drywall screwdriver as claimed in claim 10, wherein the support element connects the gear casing and the motor casing in the manner of a socket.

* * * * *